US007787784B2

(12) United States Patent
Hori

(10) Patent No.: US 7,787,784 B2
(45) Date of Patent: Aug. 31, 2010

(54) POWDER CONVEYING DEVICE, DEVELOPING DEVICE, PROCESS CARTRIDGE, AND IMAGE FORMING APPARATUS

(75) Inventor: Eisuke Hori, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 277 days.

(21) Appl. No.: 11/780,674

(22) Filed: Jul. 20, 2007

(65) Prior Publication Data

US 2008/0025743 A1 Jan. 31, 2008

(30) Foreign Application Priority Data

Jul. 31, 2006 (JP) ..... 2006-207636

(51) Int. Cl.
*G03G 15/08* (2006.01)
*G03G 15/10* (2006.01)

(52) U.S. Cl. ..... 399/27; 399/61; 399/260

(58) Field of Classification Search ..... 399/27, 399/30, 61, 258, 260, 16, 381
See application file for complete search history.

(56) References Cited

U.S. PATENT DOCUMENTS 6,505,026 B2 1/2003 Hayakawa et al.
6,704,521 B2 * 3/2004 Isobe et al. ..... 399/27 X
7,062,207 B2 * 6/2006 Tsuda et al. ..... 399/260

FOREIGN PATENT DOCUMENTS

| | | |
|---|---|---|
| JP | 8-30097 | 2/1996 |
| JP | 10-239974 | 9/1998 |
| JP | 2000-231268 | 8/2000 |
| JP | 2004-139031 | 5/2004 |
| JP | 2005-24665 | 1/2005 |
| JP | 2005-114798 | 4/2005 |

OTHER PUBLICATIONS

U.S. Appl. No. 12/188,549, filed Aug. 8, 2008, Hori, et al.

* cited by examiner

*Primary Examiner*—Sandra L Brase
(74) *Attorney, Agent, or Firm*—Oblon, Spivak, McClelland, Maier & Neustadt, L.L.P.

(57) ABSTRACT

A powder conveying device includes a powder container, a powder conveying tube, a powder conveying member, and a detecting unit. The powder container is configured to contain powder. The powder conveying tube guides the powder from the powder container to a conveyance destination located downward from the powder container. The powder conveying member is located inside the powder conveying tube, and moves to convey the powder toward downstream in a conveying direction. The detecting unit is located in the powder conveying tube, and detects a remaining amount of powder. Time t2 taken to convey the maximum amount of powder satisfies t2<t1 where t1 is the sum of time required to feed recording sheets and time interval between feeding of the recording sheets.

12 Claims, 8 Drawing Sheets

POWDER CONVEYING DEVICE, DEVELOPING DEVICE, PROCESS CARTRIDGE, AND IMAGE FORMING APPARATUS

CROSS-REFERENCE TO RELATED APPLICATIONS

The present application claims priority to and incorporates by reference the entire contents of Japanese priority document, 2006-207636 filed in Japan on Jul. 31, 2006.

BACKGROUND OF THE INVENTION

1. Field of the Invention

The present invention relates to a powder conveying device, a developing apparatus, a process cartridge, and an image forming apparatus.

2. Description of the Related Art

Image forming apparatuses, such as copiers, facsimile machines, and printers, that employ a toner conveying device have been known. The toner conveying device includes a toner discharging unit that discharges toner out of a toner container, and a conveying tube that connects the interior of a developing device that develops a latent image carried on a latent image carrier, such as a photosensitive drum, and the toner container. The toner discharging unit is activated as necessary, discharges the toner contained in the toner container to the conveying tube, and directly conveys the toner into the developing device through the conveying tube. If the toner container is arranged at a position lower than the position of the developing device in an image forming apparatus including the toner conveying device, it is required to convey the toner, which is the powder that has been passed through the conveying tube, by carrying the toner up against gravity toward the developing device. As a result, the conveying efficiency is degraded, or the toner becomes likely to get jammed inside the conveying tube. Therefore, generally, the toner container is arranged at a position higher than the position of the developing device to convey the toner in the direction of gravity. Japanese Patent Application Laid-Open No. H08-30097, for example, discloses a conventional toner conveying device that performs such toner conveyance in the direction of gravity. The conventional toner conveying device sends toner that has been discharged out of a toner box as a toner container into a conveying tube by a toner discharging device, to the developing device by letting the toner fall with weight thereof.

With the conventional toner conveying device, however, the sectional area of a coil is small with respect to the sectional area of a space inside the conveying tube. Therefore, a part of the section that is not occupied by the section of the coil becomes a clearance through which the toner can pass. Accordingly, when a large amount of toner is discharged at once from the toner container, the toner can flow through the clearance, and can flow into the developing device regardless of rotation of the coil. As a result, a refilling control of toner to the developing device becomes unstable.

Japanese Patent Application Laid-Open No. 2005-24665 discloses a conventional powder conveying device that includes a powder container that contains powder, and a powder conveying tube to guide the powder from the powder container to a destination that is positioned downward relative to the powder container, and that conveys the powder to the destination by passing the powder through the conveying tube. In the conventional powder conveying device, a powder conveying member is provided that is installed inside the conveying tube, and that provides, to the powder, a traveling force to travel downstream in the conveying direction by movement thereof to convey the powder, and a portion that has a higher performance in controlling the powder passage inside the tube than other portions of the powder conveying member in the powder conveying tube is provided at least at one part inside the powder conveying tube.

However, because refilling of the powder is performed when the developing device, which is the destination of the powder, requires the powder according to the required amount, a driving time of a refilling motor becomes long when an image having large image area is processed.

The powder has a small particle diameter to improve image quality. If such powder having a small particle diameter is stirred with air, the volume of the powder increases, and fluidity of the powder increases like liquid. On the other hand, if the powder is left for a long time, the powder enters in even a small space, the volume decreases, and the fluidity is deteriorated.

If images having a large image area is successively printed, toner in a sub-hopper is constantly mixed with a small amount of air present in space, and fluidity increases. If the fluidity increases, friction with the wall of the powder container or with the powder conveying member decreases. Even if driving is stopped, the powder can still be conveyed (flowing) a little. This phenomenon problematically causes accumulation and increase of space at the uppermost stream portion (near a sensor) in the sub-hopper.

In the conventional technologies, if the flowing of the powder in the sub-hopper and the blocking of the powder container occur at the same time, the amount of air at the portion near the sensor exceeds the threshold. As a result, the sensor detects the air to cause the apparatus to erroneously recognize that there is "no toner".

SUMMARY OF THE INVENTION

It is an object of the present invention to at least partially solve the problems in the conventional technology.

According to an aspect of the present invention, a powder conveying device includes a powder container that is configured to contain powder, a powder conveying tube that guides the powder from the powder container to a conveyance destination located downward relative to the powder container, a powder conveying member that is located inside the powder conveying tube and moves to apply a force to the powder to convey the powder toward downstream in a conveying direction, and a detecting unit that is located in the powder conveying tube and detects a remaining amount of powder. Time $t2$ taken to convey the maximum amount of powder satisfies $t2<t1$ where $t1$ is the sum of time required to feed recording sheets and time interval between feeding of the recording sheets.

According to another aspect of the present invention, a powder conveying device includes a powder container that is configured to contain powder, a powder conveying tube that guides the powder from the powder container to a conveyance destination located downward relative to the powder container, a powder conveying member that is located inside the powder conveying tube and moves to apply a force to the powder to convey the powder toward downstream in a conveying direction, and a detecting unit that is located in the powder conveying tube and detects a remaining amount of powder. Time interval between feeding of recording sheets for successive printing of images with a large image area is set longer than time interval between feeding of recording sheets for normal printing.

According to still another aspect of the present invention, a powder conveying device includes a powder container that is configured to contain powder, a powder conveying tube that guides the powder from the powder container to a conveyance destination located downward relative to the powder container, a powder conveying member that is located inside the powder conveying tube and moves to apply a force to the powder to convey the powder toward downstream in a conveying direction, and a detecting unit that is located in the powder conveying tube, and detects a remaining amount of powder. The maximum amount of powder to be conveyed is controlled.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. In the following description, the present invention is applied to an electrophotographic printer as an example of an image forming apparatus.

Figure 1:
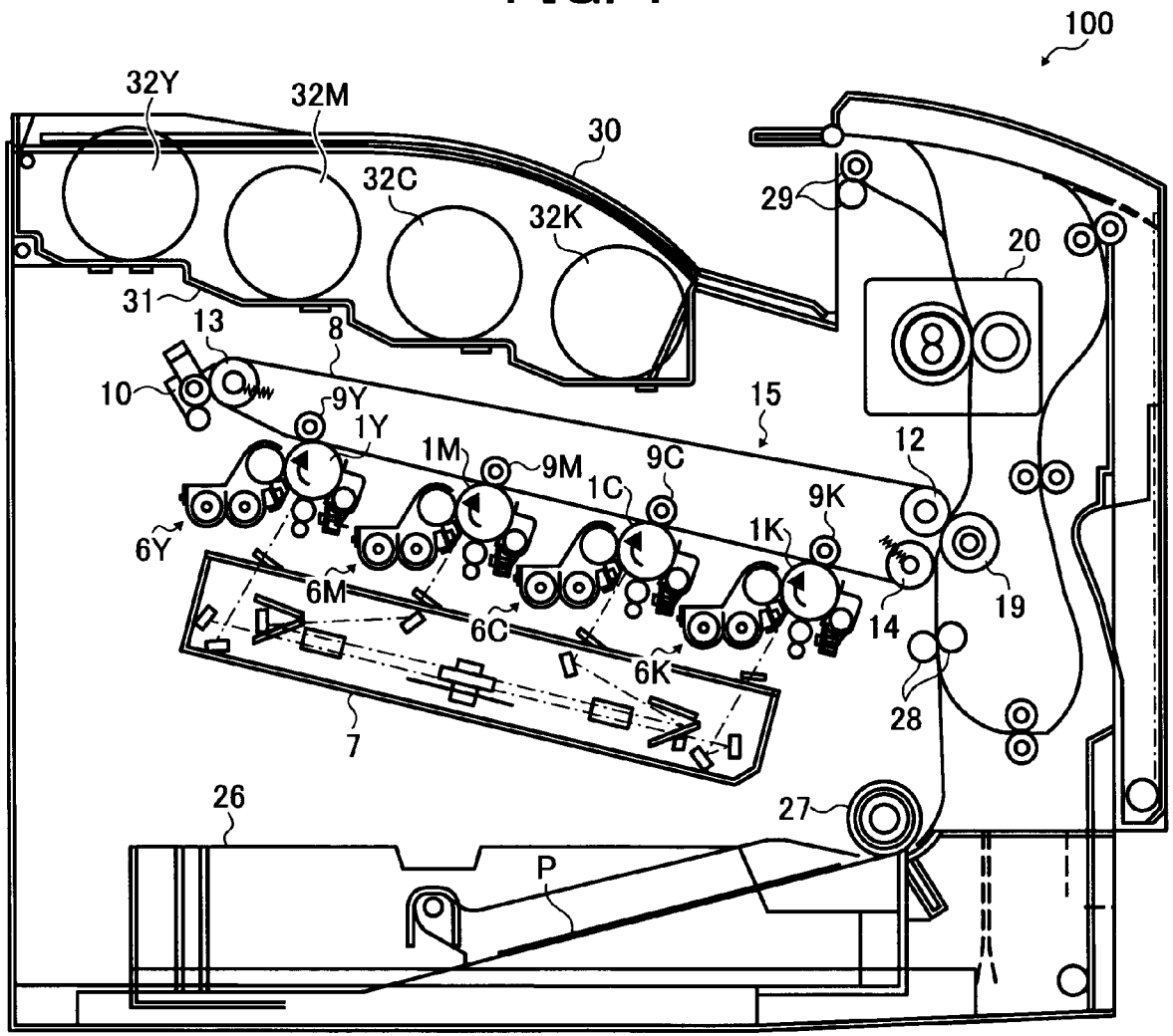
FIG. 1 is a schematic diagram of an image forming apparatus according to an embodiment of the present invention.

FIG. 1 is a schematic diagram of a printer 100 according to an embodiment of the present invention. The printer 100 includes four process cartridges 6Y, 6M, 6C, and 6K for forming toner images of yellow (Y), magenta (M), cyan (C), and black (K), respectively. The process cartridges 6Y, 6M, 6C, and 6K are replaced when reaching their service life. The process cartridges 6Y, 6M, 6C, and 6K are of basically similar construction except that they use Y, M, C, and K toners of different colors, and thus but one of them, for example, the process cartridge 6Y for forming a Y toner image is described in detail.

Figure 2:
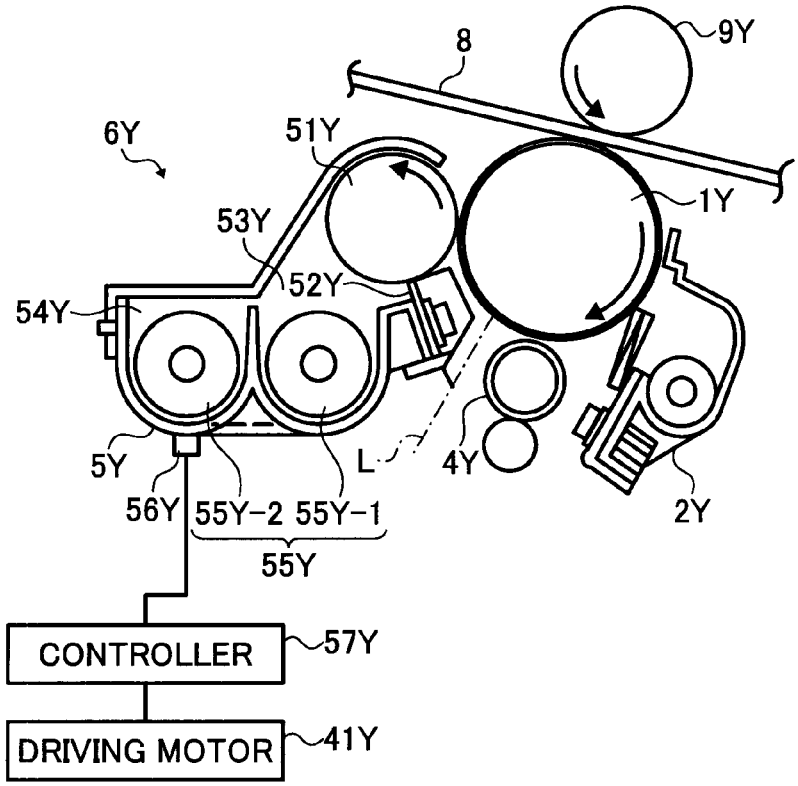
FIG. 2 is an enlarged view of a process cartridge shown in FIG. 1.

FIG. 2 is an enlarged view of the process cartridge 6Y. The process cartridge 6Y includes a photosensitive drum 1Y, a cleaning device 2Y, an electrostatic discharger (not shown), a charger 4Y, a developing device 5Y. The process cartridge 6Y is attachable to and detachable from the main body of the printer 100 to enable consumable parts to be replaced at one time.

As described above, the process cartridges 6Y, 6M, 6C, and 6K each include a photosensitive drum, a cleaning device, an electrostatic discharger, a charger, and a developing device, and are configured to be integrally attached to and detached from the main body of the printer. These components have been separately attachable and detachable consumable parts, and to be replaced as necessary. However, such a configuration makes maintenance difficult because it is difficult to make operators understand attaching and detaching operations for each part.

A process cartridge system has been proposed to integrally replace these components for easy maintenance, in which the time when toner in the developing device is exhausted is regarded as the end of its service life. However, in such a configuration, even a part that still has sufficient life at the point when toner is exhausted is replaced, and there has been a disadvantage that wasted parts increase.

For example, Japanese Patent Application Laid-Open No. H10-239974 discloses an image forming apparatus having a toner container that is attachable to and detachable from the process cartridge. In such an image forming apparatus, however, even when only a toner container needs to be replaced, the process cartridge is required to be removed from the image forming apparatus. Thus, a problem arises in replacability of toner containers.

In the printer 100, these problems are solved by configuring the process cartridges 6Y, 6M, 6C, and 6K and toner bottles 32Y, 32M, 32C, and 32K to be separately attachable to and detachable from the main body of the printer.

The charger 4Y uniformly charges the surface of the photosensitive drum 1Y that is rotated clockwise in FIG. 1 by a driving unit (not shown). The surface of the photosensitive drum 1Y that has been uniformly charged is exposed to be scanned by a laser beam L and carries a Y latent image. This Y latent image is developed by the developing device 5Y to a Y toner image, and then intermediate transferred onto an intermediate transfer belt 8. The cleaning device 2Y cleans residual toner remained on the surface of the photosensitive drum 1Y that is subjected to the intermediate transfer process. The electrostatic discharger discharges a residual electrical charge on the photosensitive drum 1Y after the cleaning. This discharge initializes the surface of the photosensitive drum 1Y to be ready for next image forming. Similarly in the other process cartridges 6M, 6C, and 6K, M, C, and K toner images are formed on photosensitive drums 1M, 1C, and 1K, and are transferred onto the intermediate transfer belt 8.

As shown in FIG. 1, an exposing device 7 is arranged below the process cartridges 6Y, 6M, 6C, and 6K. The exposing device 7 as a latent-image forming unit exposes the photosensitive drums 1Y, 1M, 1C, and 1K to the laser beam L emitted from a light source based on image information. By this exposure, Y, M, C, and K latent images are formed on the photosensitive drums 1Y, 1M, 1C, and 1K. The exposing device 7 irradiates the photosensitive drums 1Y, 1M, 1C, and 1K with the laser beam L through a plurality of optical lenses and a mirror while scanning the laser beam L with a polygon mirror that is rotated by a motor.

Below the exposing device 7 in FIG. 1 is arranged a sheet feeding unit that includes a sheet cassette 26, a feeding roller 27, and a resist roller pair 28. The sheet cassette 26 contains a stack of transfer sheets P as recording medium, and the feeding roller 27 abuts a transfer sheet P on the top. When the feeding roller 27 is rotated counterclockwise in FIG. 1 by a driving unit (not shown), the top one of the transfer sheets P is fed toward between rollers of the resist roller pair 28. The resist roller pair 28 rotates both rollers to sandwich the transfer sheet P, and stops the rotation once, soon after the transfer sheet P is sandwiched therebetween. The resist roller pair 28 sends the transfer sheet P to a secondary transfer nip described later at appropriate timing. In the sheet feeding unit, a conveying unit is formed of a combination of the feeding roller 27 and the resist roller pair 28 serving as timing rollers. This conveying unit conveys the transfer sheet P from the sheet cassette 26 serving as a storing unit to the secondary transfer nip described later.

Above the process cartridges 6Y, 6M, 6C, and 6K in FIG. 1 is arranged an intermediate transfer unit 15 that endlessly moves the intermediate transfer belt 8 as the intermediate transfer medium kept in a tensioned state. The intermediate transfer unit 15 includes four primary-transfer bias rollers 9Y, 9M, 9C, and 9K, and a cleaning device 10 in addition to the intermediate transfer belt 8. The intermediate transfer unit 15 further includes a secondary-transfer backup roller 12, a cleaning backup roller 13, a tension roller 14, and the like. The intermediate transfer belt 8 is held in a tensioned manner by these three rollers and is endlessly moved counterclockwise in FIG. 1 by a rotation driving force of at least one of the rollers. The primary-transfer bias rollers 9Y, 9M, 9C, and 9K catch the intermediate transfer belt 8, which is thus endlessly moved, between the primary-transfer bias rollers 9Y, 9M, 9C, and 9K and the photosensitive drums 1Y, 1M, 1C, and 1K, thereby forming a primary transfer nip. Such a configuration is to apply a transfer bias having an opposite polarity (for example, positive) to that of the toner on a rear surface (inner periphery surface) of the intermediate transfer belt 8. The rollers except the primary-transfer bias rollers 9Y, 9M, 9C, and 9K are all electrically grounded. On the intermediate transfer belt 8, the Y, M, C, and K toner images on the photosensitive drums 1Y, 1M, 1C, and 1K are superimposed in the process of sequentially passing through the primary transfer nips for Y, M, C, and K as the intermediate transfer belt 8 is endlessly moved, thereby performing the primary transfer. As a result, a superimposed toner image of four colors (hereinafter, "four-color toner image") is formed on the intermediate transfer belt 8.

The secondary-transfer backup roller 12 forms the secondary transfer nip with a secondary transfer roller 19 by sandwiching the intermediate transfer belt 8 therebetween. The four-color toner image formed on the intermediate transfer belt 8 is transferred to the transfer sheet P at this secondary transfer nip. On the intermediate transfer belt 8 that has passed the secondary transfer nip, transfer residual toner that has not been transferred to the transfer sheet P adheres. This residual toner is cleaned by the cleaning device 10.

At the secondary transfer nip, the transfer sheet P is conveyed in the opposite direction relative to the resist roller pair 28, being sandwiched between the intermediate transfer belt 8 and the secondary transfer roller 19 that make surface movement in a forward direction. The transfer sheet P sent out from the secondary transfer nip passes between rollers of a fixing device 20. At this time, the four-color toner image that has been transferred onto the surface of the transfer sheet P is fixed by heat and pressure. Thereafter, the transfer sheet P is discharged out of the apparatus through between rollers of a discharge roller pair 29. A stack 30 is formed on a top of the main unit of the printer, and the transfer sheet P that has discharged out of the apparatus by the discharge roller pair 29 is sequentially stacked on the stack 30.

The developing device 5Y in the process cartridge 6Y is explained below. The developing device 5Y has a magnetic-field generating unit inside, and includes a developing sleeve 51Y as a developer carrier that conveys two component developer containing magnetic particles and toner carrying on the surface, and a doctor 52Y as a developer control member that controls the layer thickness of the developer that is carried on the developing sleeve 51Y. A developer container 53Y that holds developer that is not carried to the developing area to become a subject of the control is formed at a portion upstream in the direction of conveying the developer. Furthermore, the developing device 5Y includes a toner container 54Y that is arranged adjacent to the developer container 53Y and that contains toner, and a toner carrying screw 55Y to agitate and carry the toner.

The operation of the developing device 5Y is explained next. In the developing device 5Y, a developer layer is formed on the developing sleeve 51Y. The toner is taken in the developer from the developer container 53Y by movement of the developer layer that is carried by rotation of the developing sleeve 51Y. The toner is taken in to make the toner concentrations of the developer within a predetermined toner concentration range. The toner taken into the developer is charged by triboelectric charge with carrier. The developer containing the charged toner is supplied to the surface of the developing sleeve 51Y having a magnetic pole inside, and is carried by a magnetic force. The developer layer that is carried on the developing sleeve 51Y is conveyed in a direction of an arrow along the rotation of the developing sleeve 51Y. After the layer thickness is controlled by the doctor 52Y on the way, the developer layer is conveyed to the developing area. In the developing area, development based on a latent image formed on the photosensitive drum 1Y is performed. The developer layer remained on the developing sleeve 51Y is conveyed to the developer container 53Y at an upstream portion in the direction of conveying the developer.

As shown in FIG. 1, a bottle holder 31 is arranged between the intermediate transfer unit 15 and the stack 30 that is arranged upstream to this unit. The bottle holder 31 holds the toner bottles 32Y, 32M, 32C, and 32K that contain Y, M, C, and K toners, respectively. The toner bottles 32Y, 32M, 32C, and 32K are set by putting on the bottle holder 31 from the top for each color. The toner in each of the toner bottles 32Y, 32M, 32C, and 32K are supplied to the developing device of the process cartridges 6Y, 6M, 6C, and 6K as necessary by the toner conveying device. The toner bottles 32Y, 32M, 32C, and 32K are attachable to and detachable from the main unit of the printer 100 independently from the process cartridges 6Y, 6M, 6C, and 6K.

Figure 3:
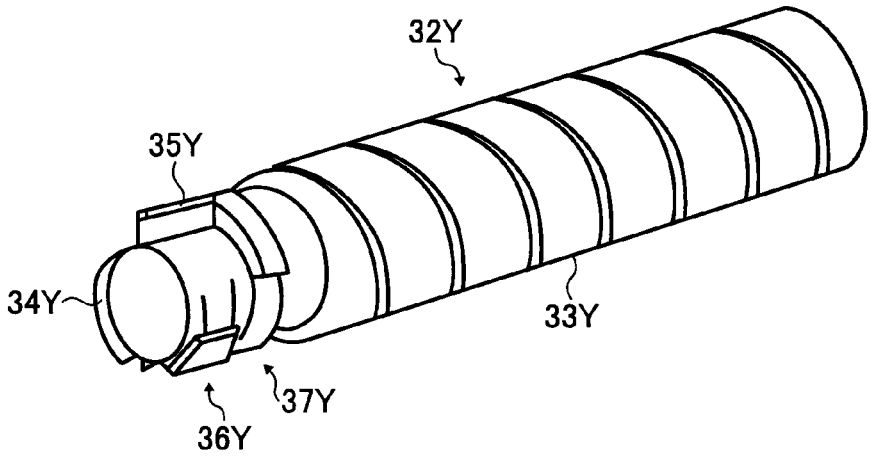
FIG. 3 is a perspective view of a toner bottle shown in FIG. 1.
Figure 4:
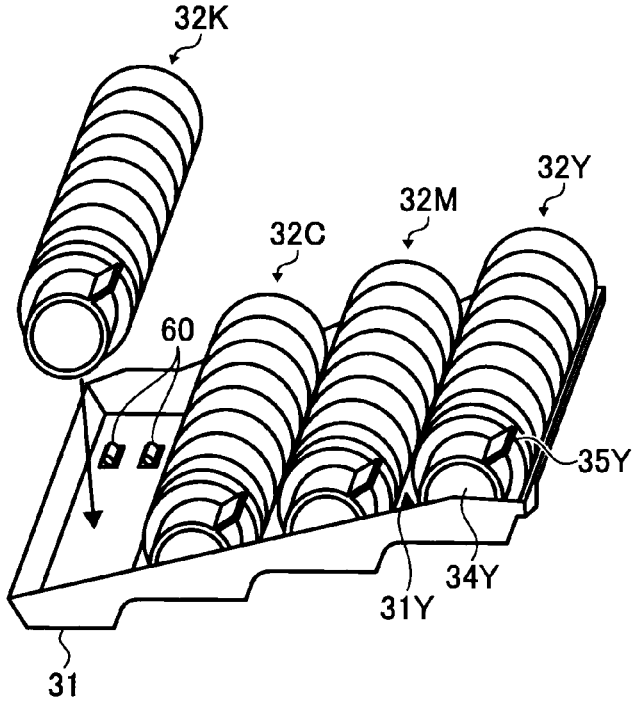
FIG. 4 is a perspective view of a bottle holder and four toner bottles shown in FIG. 1.

FIG. 3 is a perspective view of the toner bottle 32Y. FIG. 4 is a perspective view of the bottle holder 31 where the toner bottle 32K is to be set. The toner bottle 32Y includes a bottle main body 33Y, a resin case 34Y, a handle 35Y, a shutter 36Y, and a gear 37Y. The resin case 34Y is located at the end of the bottle main body 33Y. The handle 35Y is integrally formed on the resin case 34Y. The gear 37Y integrally rotates with the bottle main body 33 on a side of the resin case 34Y. When the toner bottle 32Y is to be set in the main unit of the printer 100, it is ensured to open the stack 30 upward to expose the bottle holder 31. After the toner bottle 32Y is set on the bottle holder 31 as shown in FIG. 4, the handle 35Y is rotated. As a result, the resin case 34Y that is integrally formed with the handle 35Y is rotated, the shutter 36Y moves in a circumferential direction of the resin case 34Y to be open a toner discharge port (not shown). At the same time the resin case 34Y and the bottle holder 31 are connected and fixed. On the other hand, when the toner bottle 32Y is to be removed from the main unit of the printer 100, by rotating the handle 35Y in the opposite direction, the connection between the resin case 34Y and the bottle holder 31 is released, and at the same time, the shutter 36Y closes the toner discharge port. The toner bottle 32Y can be removed from the main unit of the printer 100 while holding the handle 35Y. As described above, the toner bottle 32Y can be attached and detached by handling from the top side of the main unit of the printer 100, whereby the toner bottle 32Y can be easily replaced. Besides, because the handle 35Y is formed on the resin case 34Y, it is possible to fix the toner bottle 32Y to the bottle holder 31 easily by rotating the resin case 34Y. In a state in which the toner bottle 32Y is removed from the main unit of the printer 100, the shutter 36Y does not open even if the handle 35Y of the resin case 34Y is rotated. This enables to prevent the shutter 36Y from opening by mistake during the replacement work and the toner inside from spilling out of the toner bottle 32Y.

Figure 5:
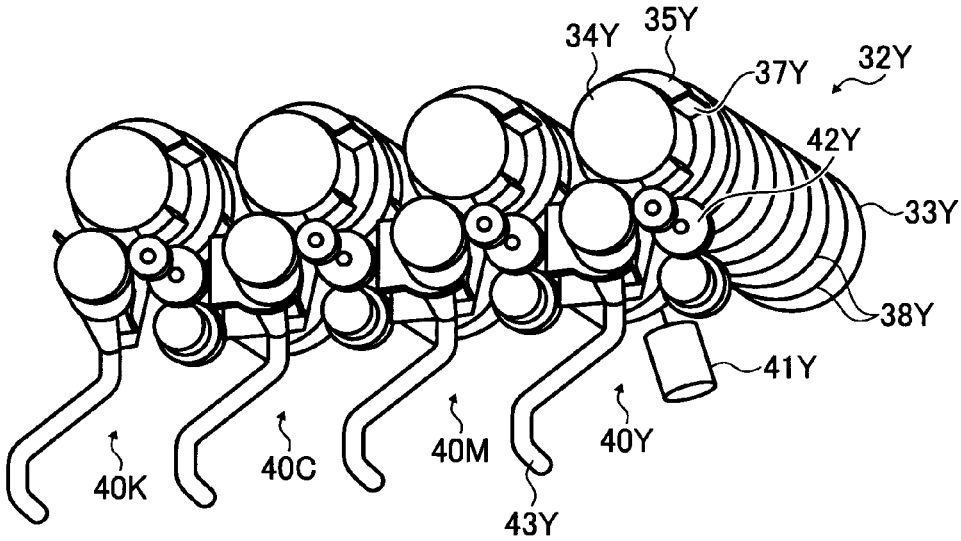
FIG. 5 is a perspective view of toner conveying devices of the image forming apparatus.
Figure 6:
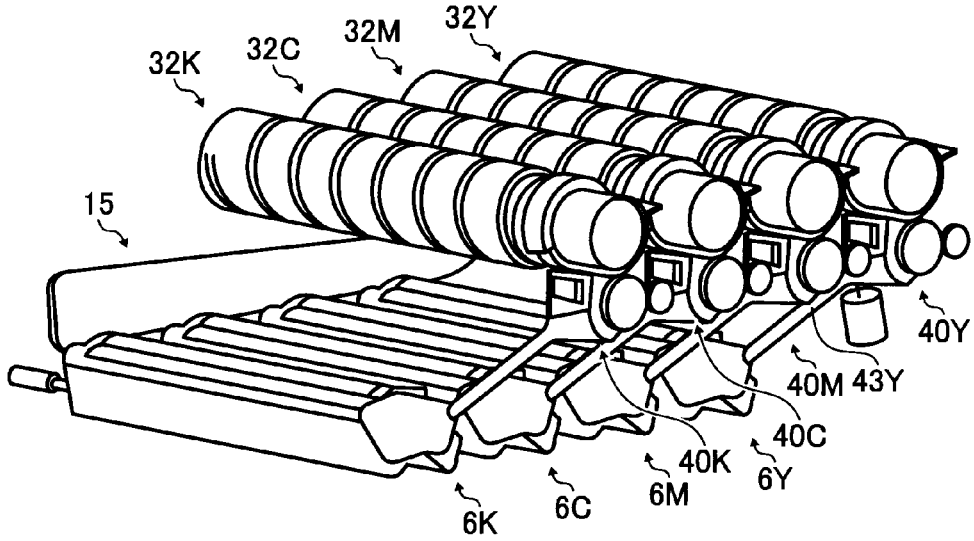
FIG. 6 is a perspective view of process cartridges and the toner conveying devices.

FIG. 5 is a perspective view of the toner bottles 32Y, 32M, 32C, and 32K and toner conveying devices 40Y, 40M, 40C, and 40K. FIG. 6 is a perspective view of the toner bottles 32Y, 32M, 32C, and 32K, the intermediate transfer unit 15, and the toner conveying devices 40Y, 40M, 40C, and 40K viewed from another angle. The toner conveying devices 40Y, 40M, 40C, and 40K are provided in the main unit of the printer 100 on a side of the intermediate transfer unit 15. Therefore, the process cartridges 6Y, 6M, 6C, and 6K or the toner bottles 32Y, 32M, 32C, and 32K are not required to be equipped with the toner conveying unit. Thus, the process cartridges 6Y, 6M, 6C, and 6K and the toner bottles 32Y, 32M, 32C, and 32K can be minimized compared with those of a conventional technology. With the conventional technology, because the process cartridges and the toner bottles are arranged adjacent to each other, there is a limit on design flexibility. In contrast, according to the embodiment, the process cartridges and the toner bottles can be arranged at portions away from each other, and therefore, flexibility in design is improved and miniaturization of the printer can be achieved.

Furthermore, the discharge port of the toner bottles 32Y, 32M, 32C, and 32K, the toner conveying devices 40Y, 40M, 40C, and 40K, and a toner supply port of toner containers 54 in developing devices 5, as shown in *Fig.* 2 are disposed on a side of one end of the intermediate transfer unit 15. Therefore, a toner conveyance route of the toner conveying devices 40Y, 40M, 40C, and 40K can be minimized, miniaturization of the printer can be achieved, and clogging during the toner conveyance can be prevented.

The toner conveying devices 40Y, 40M, 40C, and 40K are of basically similar construction, and thus but one of them, for example, the toner conveying device 40Y for the Y toner is explained. As shown in FIG. 5, the toner conveying device 40Y includes a driving motor 41Y, a driving gear 42Y, and a toner conveying pipe 43Y. Inside the toner conveying pipe 43Y is provided a resin coil (not shown). The driving gear 42Y engages with the gear 37Y of the toner bottle 32Y, and when the driving motor 41Y is rotated, the bottle main body 33Y that integrally rotates with the gear 37Y is rotated. When a concentration sensor 56Y detects insufficient toner concentration in the toner container 54Y, the driving motor 41Y rotates according to a supply signal from a controller 57Y. Because a spiral developer guiding groove 38Y is formed on the inner surface of the bottle main body 33Y, toner inside is carried from the back side to the end side of the resin case 34Y by rotation. The toner inside the bottle main body 33Y falls into a toner catcher (not shown) of the toner conveying device 40Y through a discharge port (not shown) of the resin case 34Y. The toner catcher is connected to the toner conveying pipe 43Y, and when the driving motor 41Y is rotated, a coil inside the toner conveying pipe 43Y rotates synchronously with the rotation of the bottle main body 33Y. The toner fell into the toner catcher by the rotation of the coil is conveyed through the toner conveying pipe 43Y, and supplied to the toner supply port (not shown) of the toner container 54Y in the developing device 5Y. Thus, the toner concentration inside the developing device 5Y is adjusted.

Instead of arranging the concentration sensor 56Y, a reference image can be formed on the photosensitive drum 1Y and an optical sensor or a charge coupled device (CCD) camera to measure pixels of the reference image can be provided to supply toner based on a result of measurement.

Figure 7:
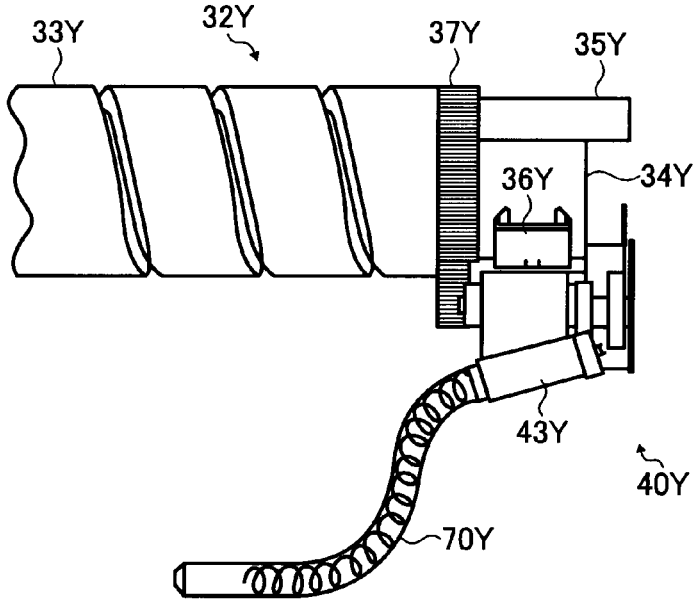
FIG. 7 is an enlarged view of part of one of the toner conveying device.

Salient features of the embodiment are explained next. FIG. 7 is an enlarged view of part of the toner conveying device 40Y serving as a powder conveying device for Y. As shown in FIG. 7, a conveyance coil 70Y as a powder conveying member is arranged to contact the inner wall of the toner conveying pipe 43Y as a powder conveying tube. A space between the toner conveying pipe 43Y and the conveyance coil 70Y is approximately 0.1 millimeter to 0.2 millimeter.

The conveyance coil 70Y inside the toner conveying pipe 43Y applies a force to the toner such that the toner travels in the conveying direction. Thus, the toner can be prevented from accumulating inside the toner conveying pipe 43Y. Accordingly, it is possible to prevent a malfunction caused by Y toner that has been accumulated inside the toner conveying pipe 43Y flowing into the developing device 5Y in the process cartridge 6Y all at once.

Furthermore, because influence of bend stress is small for a coil shape, even if the toner conveying pipe 43Y is bent, the conveyance coil 70Y can rotate. Accordingly, the toner conveying pipe 43Y is not required to be arranged in a straight shape, which improves flexibility of layout and minimizes the developing device.

Even if a conveying unit that has a screw-like axis instead of the conveyance coil 70Y is used, the toner may be conveyed in a conveyance route that is not straight. However, compared with a conveying unit having an axis, a conveying unit having a coil is easier to be bent. Therefore, when the conveyance coil is used, a repulsive force to deformation at the time of rotating in a bent portion of the toner conveying pipe 43Y becomes smaller. Thus, when the conveyance coil 70Y is used, a sliding load with respect to the toner conveying pipe 43Y can be reduced compared to a case where a conveying unit having an axis is used.

Figure 8:
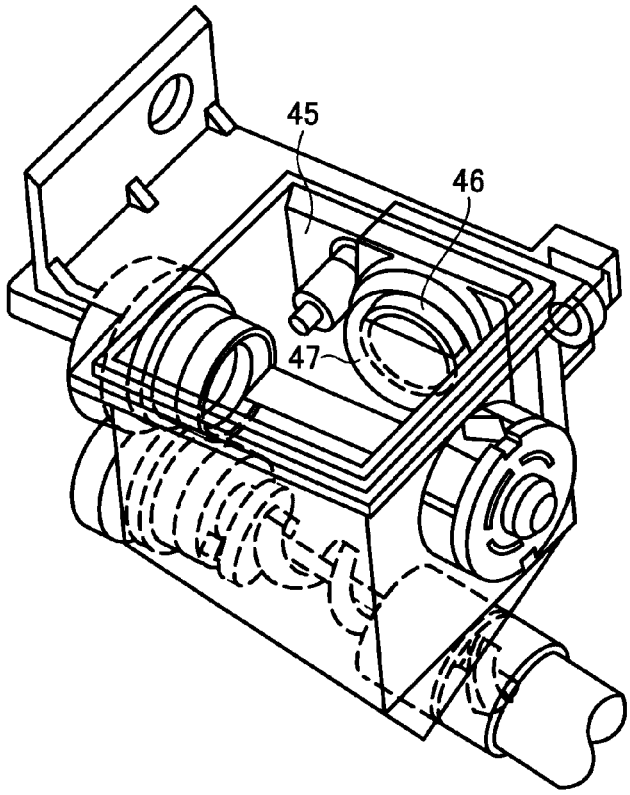
FIG. 8 is a schematic diagram of a powder conveying tube.

FIG. 8 is a schematic diagram of a powder conveying tube. The powder conveying tube includes a sub-hopper 45 that is a large space, a sensor 46 that detects presence or absence of powder inside the sub-hopper 45, and an agitator 47 that agitates powder in the sub-hopper 45 so that the powder does not harden. The agitator 47 is formed with an elastic material and is arranged such that the agitator 47 bites a detecting surface of the sensor. By rotation of the agitator 47, the detecting surface of the sensor is scraped (cleaned).

Figure 9:
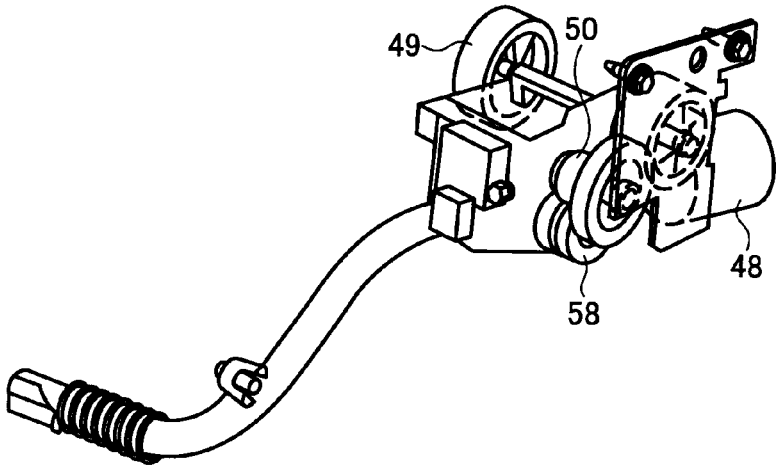
FIG. 9 is a schematic diagram of a supply motor of the image forming apparatus.

FIG. 9 is a schematic diagram of a supply motor 48. As shown in FIG. 9, the single supply motor 48 drives a spare-container driving gear 49, an agitator driving gear 50, and a powder-conveying-member driving gear 58.

The supply motor 48 drives when the developing device 5, which is a powder conveyance destination, requires powder, corresponding to a required amount. When an image having a large image area is processed, the driving time becomes long. The powder to be used has small diameter to improve image quality. If such powder having small particle diameter is stirred with air, volume of the powder increases and fluidity of the powder increases like liquid. On the other hand, if the powder is left for a long time, the powder enters in even a small space, the volume decreases, and the fluidity is deteriorated. If an image having a large image area is successively, toner in a sub-hopper is constantly mixed with air present in a small amount in space, and fluidity increases. If the fluidity increases, friction with the wall of the powder container or with the powder conveying member decreases, and even if driving is stopped, the powder is still conveyed (flowing) a little. This phenomenon causes accumulation and increase of space at the uppermost stream portion (near a sensor) in the sub-hopper.

Furthermore, if a powder container that has been stored for a long time is set to the main unit, powder can harden near an outlet because of poor fluidity thereof, and may cause a state (blocking) in which the powder is not conveyed even if driving is applied. In such a case also, space at the uppermost stream portion (near a sensor) in the sub-hopper is accumulated to be increased. However, if the powder is kept agitated, the fluidity increases in a short time, and the powder is soon filled also in the accumulated space.

In the conventional technologies, if the flowing of the powder in the sub-hopper and the blocking of the powder container occur at the same time, the amount of air at the portion near the sensor exceeds the threshold, and as a result, the sensor detects the air to cause the apparatus to erroneously recognize that there is "no toner".

Figure 10:
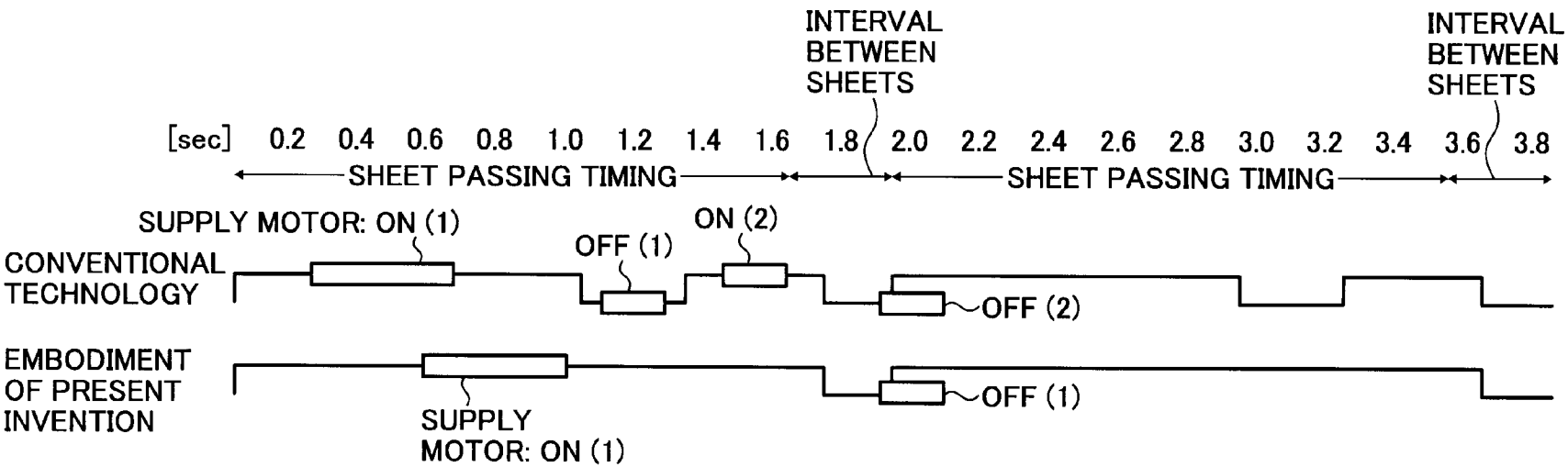
FIGS. 10 to 12 are timing charts for comparing ON/OFF control of a supply motor with that of the conventional technology.

FIG. 10 is a timing chart for comparing an example of ON/OFF control of the supply motor 48 with that of a conventional technology. In the example of FIG. 10, recording sheets in A4 size are successively fed, and it takes 1.6 seconds (sec) to feed or pass the respective recording sheets with an interval of 0.3 second between feeding of them.

FIG. 10 depicts, as an example in which the flowing most significantly occurs, ON/OFF timing of the supply motor 48 for forming a single-color full-page solid image (image formed by adhering powder on the entire area of a page except page margins). It is assumed in this example that 0.40 gram of powder is required for a single-color full-page solid image. In the conventional technology, 0.2857 gram of powder is supplied per second, and driving of the supply motor is required for 1.4 seconds in total. The 1.4-second driving is divided into two times of driving: 1-second driving and 0.4-second driving, with a 0.3-second interval therebetween. The recording sheets are fed at 0.2-second intervals (OFF time).

On the other hand, according to the embodiment, powder-supply speed is slowed down such that 0.2353 gram of powder is supplied per second, and the same amount, i.e., 0.40 gram of powder is slowly conveyed taking 1.7 seconds. Thus, the fluidity of powder in the sub-hopper is not excessively promoted, and the flowing does not occur. Although the more slowly the powder is conveyed, the higher effect is obtained, it is not desirable in terms of control if supply for a next page is performed continuously to the current supply without an interval. Therefore, considering an error of 0.1 second in measurement of control time and variation in the supply amount, OFF time of 0.2 second is provided so that the supply for the next page is not performed continuously to the current supply. The slowdown can be achieved either by reducing rotation of the motor or by increasing the number of teeth of the gear thereafter.

Figure 11:
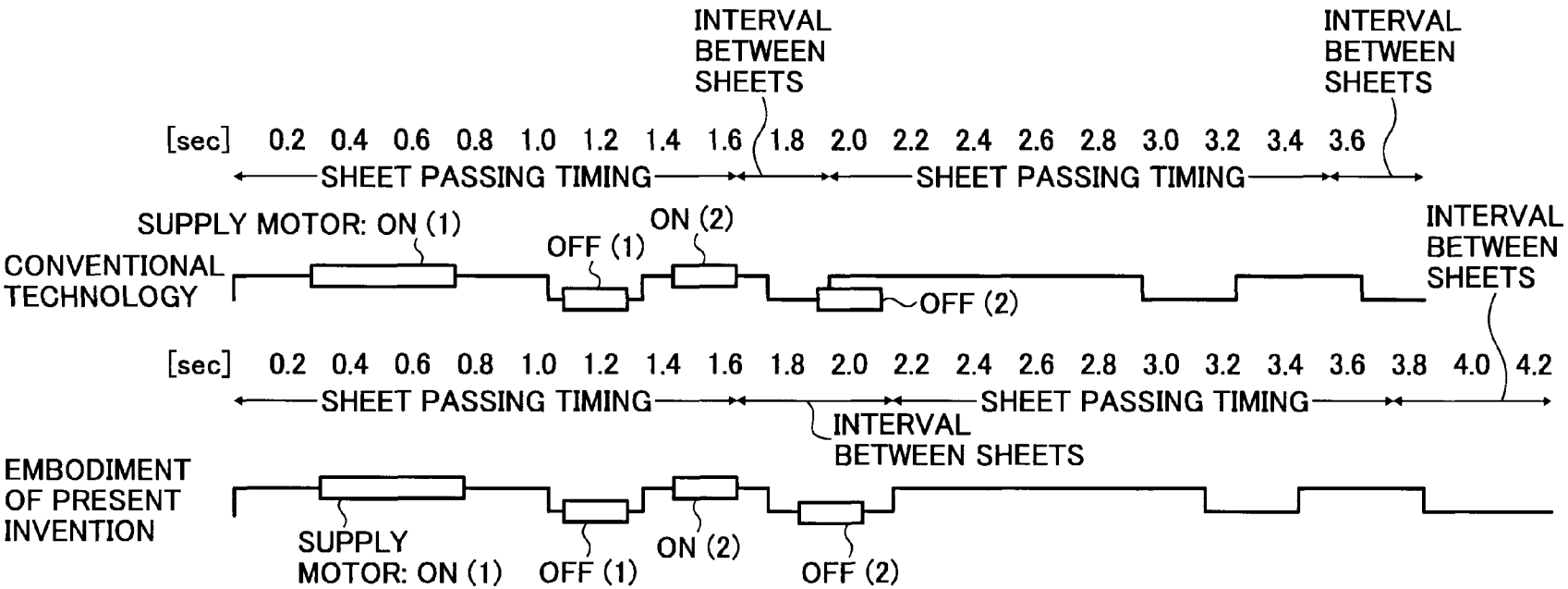

FIG. 11 is a timing chart for comparing another example of ON/OFF control of the supply motor 48 with that of the conventional technology. While in the conventional technology, the recording sheets are fed at 0.2-second intervals, in the embodiment, the interval is extended to 0.5 second. Accordingly, OFF time (OFF (2) in FIG. 11) of the supply motor 48 is extended by 0.2 second.

Thus, when images having a large image area are successively processed, a time for powder in the sub-hopper 45 to be settled is given by extending the interval between feeding of recording sheets. This enables to ease the flowing of powder in the sub-hopper 45. Because the extension of the interval between feeding of recording sheets decreases productivity of an image forming apparatus such as a copier and a printer, in this example, the interval is extended only when 80% or more of the area of an image is occupied by an image area. Thus, there is no influence of productivity decrease on regular images.

Figure 12:
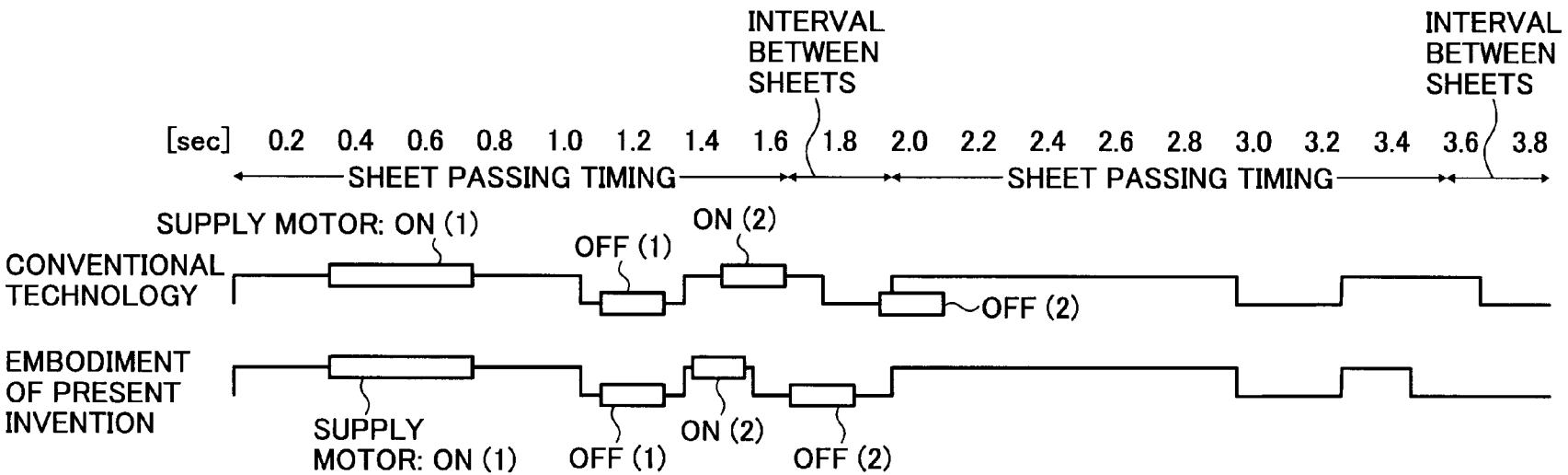

FIG. 12 is a timing chart for comparing still another example of ON/OFF control of the supply motor 48 with that of the conventional technology. While in the conventional technology, 0.40 gram of powder is used for an A4 single-color full-page solid image as described above, in the embodiment, the upper limit of supply is defined so that up to 0.34 gram of powder is to be supplied. Therefore, the total ON time of the supply motor 48 is 1.2 seconds, and the second OFF time is extended by 0.2 second. This gives a time for powder in the sub-hopper 45 to be settled, and the flowing of powder in the sub-hopper 45 caused by continuous driving can be eased.

As set forth hereinabove, according to an embodiment of the present invention, flowing can be suppressed, and the powder concentration in the developing device can be maintained stably. Thus, the amount of powder adhering on a photosensitive drum can be maintained uniformly. Therefore, density variation (excessively high density) of an output image can be suppressed.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A powder conveying device comprising:

a powder container that is configured to contain powder;

a powder conveying path that guides the powder from the powder container to a conveyance destination located downward relative to the powder container;

a powder conveying member that is located inside the powder conveying path, and moves to apply a force to the powder to convey the powder toward downstream in a conveying direction; and a detecting unit that is located in the powder conveying path, and detects a remaining amount of powder, wherein a first time interval between feeding of recording sheets for successive printing of images with a large image area is set longer than a second time interval between feeding of recording sheets for the normal printing.

2. The powder conveying device according to claim 1, wherein the first time interval is set longer than the second time interval by at least 0.1 second.

3. The powder conveying device according to claim 2, wherein the images with the large image area have an area at least 80 percent of which is occupied by the image area.

4. A developing device comprising the powder conveying device according to claim 1.

5. A process cartridge comprising the developing device according to claim 4.

6. An image forming apparatus comprising the developing device according to claim 4.

7. A process cartridge comprising the powder conveying device according to claim 1.

8. An image forming apparatus comprising the process cartridge according to claim 7.

9. An image forming apparatus comprising the powder conveying device according to claim 1.

10. The powder conveying device according to claim 1, wherein the large image area is larger than an image area of sheets having normal printing.

11. The powder conveying device according to claim 1, wherein the images with the large image area have an area at least 80 percent of which is occupied by the image area.

12. The powder conveying device according to claim 1, wherein the powder conveying path comprises a powder conveying tube.

* * * * *